US006324352B1

(12) United States Patent
Suzuki

(10) Patent No.: US 6,324,352 B1
(45) Date of Patent: Nov. 27, 2001

(54) COLOR RECORDING APPARATUS WITH PLURAL TONER CARTRIDGES

(75) Inventor: Nobuhiro Suzuki, Tochigi (JP)

(73) Assignee: Matsushita Graphic Communication Systems, Inc., Tokyo (JP)

( * ) Notice: Subject to any disclaimer, the term of this patent is extended or adjusted under 35 U.S.C. 154(b) by 0 days.

(21) Appl. No.: 09/635,442

(22) Filed: Aug. 11, 2000

(30) Foreign Application Priority Data

Sep. 2, 1999 (JP) ..... 11-249242

(51) Int. Cl.[7] ..... G03G 15/00
(52) U.S. Cl. ..... 399/13; 399/112; 399/227
(58) Field of Search ..... 399/12, 13, 27, 399/28, 227, 112

(56) References Cited

U.S. PATENT DOCUMENTS 5,809,380 * 9/1998 Katakabe et al. ..... 399/227
5,862,430 * 1/1999 Mitekura et al. ..... 399/13

FOREIGN PATENT DOCUMENTS 6-250482 * 9/1994 (JP) .

* cited by examiner

*Primary Examiner*—Joan Pendegrass
(74) *Attorney, Agent, or Firm*—Greenblum & Bernstein P.L.C.

(57) ABSTRACT

Carriage 113 storing a plurality of process cartridges 115 for each color toner is rotated to detect whether or not process cartridge 115 is stored, and when the process cartridge is not stored in rotator 113, rotator 113 is controlled so that a cartridge storage place without the process cartridge moves to a position opposite a cartridge opening.

8 Claims, 11 Drawing Sheets

「CARTRIDGE ROTATION ORDER」

「DETECTION RESULT TABLE」

| | 1ST | 2ND | 3RD | 4TH |
|---|---|---|---|---|
| BK REFERENCE POINT | 0 | 1 | 0 | 0 |
| CARTRIDGE | 0 | 0 | 1 | 1 |

「DETERMINATION RESULT TABLE」

| | C | Bk | Y | M |
|---|---|---|---|---|
| CARTRIDGE | NONE | STORED | STORED | NONE |

「DETERMINATION RESULT TABLE」 UPDATED ONCE

| | C | Bk | Y | M |
|---|---|---|---|---|
| CARTRIDGE | NONE | STORED | STORED | STORED |

「DETERMINATION RESULT TABLE」 UPDATED TWICE

| | C | Bk | Y | M |
|---|---|---|---|---|
| CARTRIDGE | STORED | STORED | STORED | STORED |

COLOR RECORDING APPARATUS WITH PLURAL TONER CARTRIDGES

BACKGROUND OF THE INVENTION

1. Field of the Invention

The present invention relates to a recording apparatus that performs recording of a color image using a plurality of process cartridge respectively storing a plurality of toners with different colors.

2. Description of the Related Art

This type of a recording apparatus is conventionally provided inside the apparatus with a rotator (hereinafter referred to as carriage) capable of storing a plurality of process cartridges detachably. In this recording apparatus, different process cartridges each for a toner with a different color are inserted into the carriage, the carriage is rotated to form each color image with the respective color of toner, while superimposing the formed color images as one image on an intermediate transfer medium, and the obtained image is transferred to recording paper.

However in the conventional technique as described above, since the apparatus is provided with the carriage, and a plurality of process cartridges corresponding to different colors are attached in the carriage, the following problems occur:

In the above-described apparatus, a predetermined cartridge opening is provided to exchange a process cartridge, and the process cartridge is attached or detached through the cartridge opening one by one, while rotating the carriage. Therefore, when the process cartridge is not attached in a storage place at a position opposite the cartridge opening, it is not possible to judge a state of the storage place easily only by viewing inside the apparatus through the cartridge opening. Thus the case tends to occur that recording is instructed with no process cartridge attached, for example, due to that an operator forgets to attach it.

It is considered in the above case to provide a sensor to determine at an initial operation time whether or not the process cartridge is attached, and to notify the absence of the process cartridge to an operator if it is not stored. However, even in the foregoing, the operator should perform some operations so that a cartridge storage place with no cartridge in the carriage moves to a position opposite a cartridge opening, resulting in the problem that the operations required until the process cartridge is attached are complicated.

SUMMARY OF THE INVENTION

An object of the present invention is to provide a recording apparatus, which is provided with a rotator for storing a plurality of process cartridges for each toner with a different color, enabling an operator to attach a process cartridge without performing a complicated operation when it is determined that either of the process cartridges is not attached.

The recording apparatus of the present invention rotates the rotator, which stores the plurality of process cartridges each with a different color toner, to detect which process cartridge is not stored, and when any cartridge is not stored in the carriage, controls the carriage to move a cartridge storage place in which the rotator does not store the process cartridge to a position opposite a cartridge opening.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DETAILED DESCRIPTION OF THE PREFERRED EMBODIMENTS

An embodiment of the present invention will be described below specifically with reference to accompanying drawings.

Figure 1:
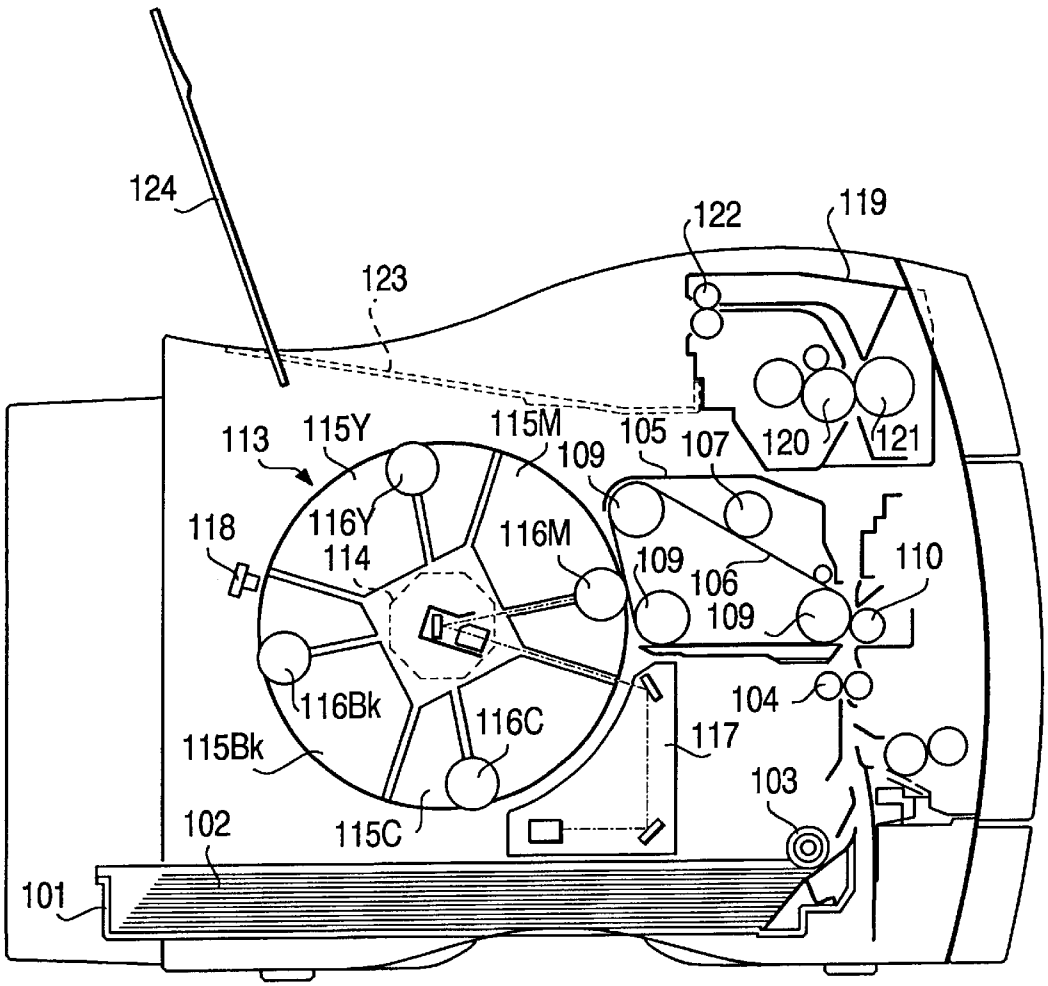
FIG. 1 is an entire structure diagram of a recording apparatus according to one embodiment of the present invention.

FIG.1 is a schematic sectional view illustrating a structure of a recording apparatus according to one embodiment of the present invention. As illustrated in FIG. 1, the recording apparatus is provided at a bottom thereof paper cassette 101. Pick-up roller 103 picks up recording paper from the top sheet of recording paper bunch 102 placed in paper cassette 101. The recording paper picked up from paper cassette 101 is provided to transfer unit 105 through register roller 104.

Transfer unit 105 has transfer film 106 on which four images with respective colors are superimposed, cleaning roller 107 that removes toners remained on transfer film 106. Transfer film 106 is supported by three transfer film carry rollers 109, and rotated by a driving motor not shown in the figure. Transfer roller 110 is provided being opposite transfer film carry roller 109 that is positioned at a portion such that transfer film 106 contacts the recording paper. Transfer roller 110 transfers a color image superimposed on transfer film 106 to the recording paper.

Process unit 113 is provided neighboring to transfer unit 105. Process unit 113 is comprised of a carriage in which process cartridges of four colors 115Y, 115M, 115C and 115Bk are inserted radially around rotation shaft 114 of the carriage as a center. Process cartridges 115Y, 115M, 115C and 115Bk respectively have photoconductive materials 116Y, 116M, 116C and 116Bk on which an electrostatic latent image with a respective color is formed. The carriage has storage places each mechanically predetermined to store one of process cartridges 115Y, 115M, 115C and 115Bk so that each of the places does not store a process cartridge with a different color toner other than the predetermined one, and the process cartridges respectively with yellow, magenta, cyan and black toners are provided in this order. In addition, the structure of the process cartridge is not limited to that of this embodiment as long as the process cartridge can be stored in the rotating carriage, and it may be possible to remove a photoconductive material from the process cartridge to configure as a separated body.

LSU 117 is comprised of a laser light source, polygon mirror and others, and forms an electrostatic latent image on a photoconductive material arriving at a development position. The carriage is rotated, while being stopped so that photoconductive materials 116Y, 116M, 116C and 116Bk each sequentially stops at the development position to form the electrostatic latent image with a respective color, and thereby images each with one of four colors of yellow, magenta, cyan and black are superimposed at the same position of transfer film 106.

Carriage reference sensor 118 is provided to stop each of photoconductive materials 116Y, 116M, 116C and 116Bk accurately at the development position. Carriage reference sensor 118 detects a rib provided in the process cartridge (hereinafter referred to as cartridge detection rib) for use in detecting whether or not the process cartridge is stored, and another rib provided in a side board of the carriage (hereinafter referred to as reference detection rib) for use in detecting a reference point of the carriage. An installation point of carriage reference sensor 118, and the cartridge detection rib and reference detection rib are described later.

Transfer roller 110 transfers the image superimposed on transfer film 106 to the recording paper. A position adjustment between transfer film 106 and a head of the recording paper is performed by register roller 104.

The recording paper with the color image transferred thereon is carried from transfer unit 105 to fixing unit 119. Fixing unit 119 is provided with fixing roller 120 and pressurizing roller 121. Fixing roller 121 applies a heat to a recording surface of the recording paper, and pressurizing roller 121 presses the recording paper against fixing roller 120, and thereby the image is fixed on the recording paper. Discharge roller 122 is provided at an outlet of fixing unit 119.

On the top surface of the main body of the apparatus, cartridge opening 123 with a size enabling attachment and detachment of a single cartridge is provided at a region generally above process unit 113. Namely, a process cartridge is exchanged or attached one by one through a single cartridge opening 123 by rotating the carriage sequentially. As a result of this structure, it is possible to make cartridge opening 123 compact even in the case where the exchange of a plurality of process cartridges is required in a recording apparatus for recording a color image. Cartridge opening 123 can be opened and closed by door 124.

Figure 2:
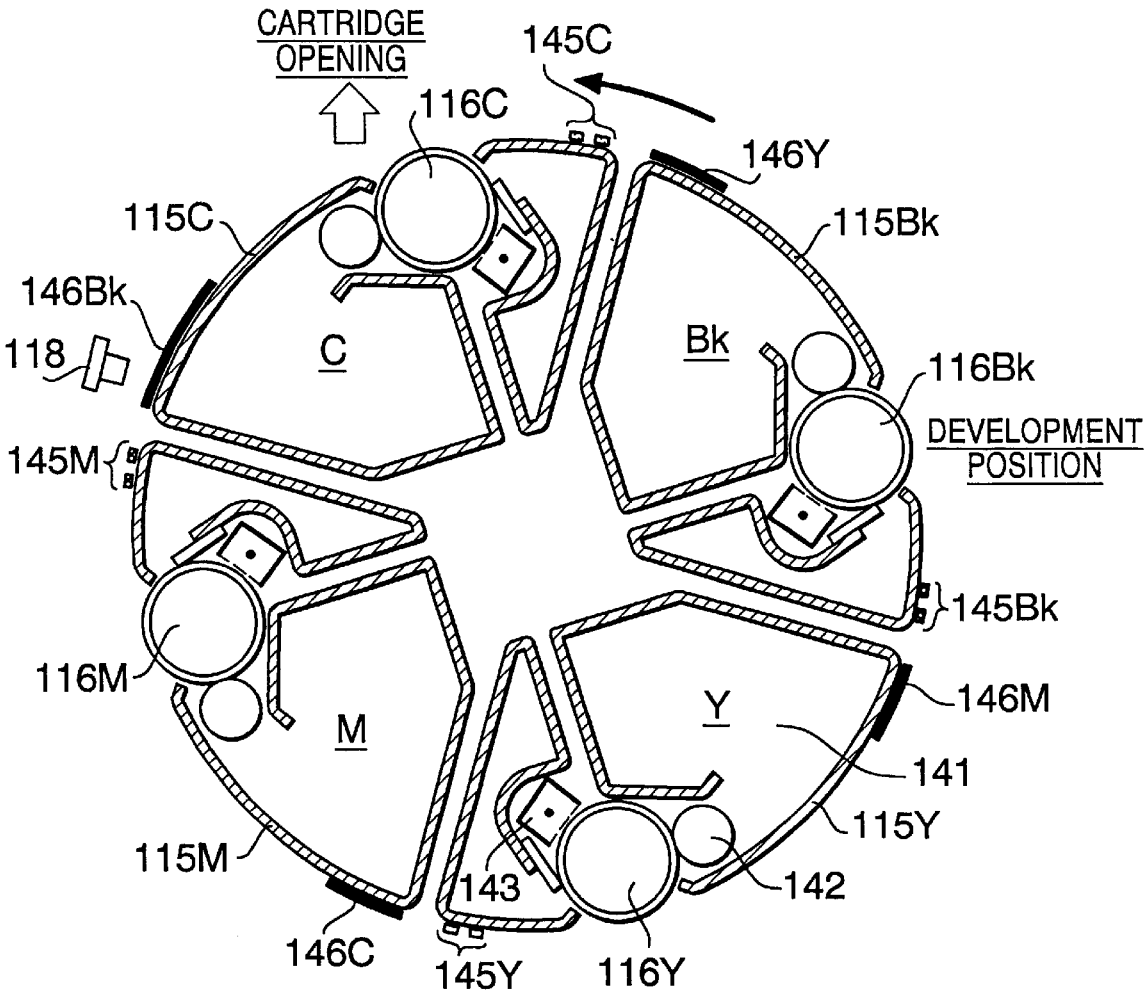
FIG. 2 is a sectional side view of a process unit according to the above embodiment.

FIG. 2 is a sectional side view of process unit 113 with all the process cartridges attached in the carriage. Process cartridges each for one color have the same structure, and the structure is explained using process cartridge 115Y as an example. Toner (yellow) in toner storage box 141 is provided to toner supply box 142, while corona charger 143 provided being opposite photoconductive material 116Y uniformly charges photoconductive material 116Y. When photoconductive material 116Y arrives at the development position, LSU 117 forms a latent image on the surface of uniformly charged photoconductive material 116Y. The toner supplied from toner supply box 142 adheres to the latent image portion, and thereby the image is formed.

In addition, cartridge detection rib 145Y is provided on an outer surface of process cartridge 115Y. Cartridge detection rib 145Y is provided at a rear edge, in the rotation direction of the carriage, on the surface. The carriage rotates in the direction of the arrow in the figure by a carriage driving motor not shown in the figure. Process cartridges for other different colors are respectively provided with cartridge detection ribs 145C, 145M and 145Bk in the same way as 145Y.

Reference detection ribs 146C, 146M, 146Y and 146Bk are provided on the side board of the carriage that supports the process cartridges for different colors. The reference detection ribs each is provided to be adjacent to a rear side, in the rotation direction, of the cartridge detection rib provided at the rear edge on the outer surface of the process cartridge. In other words, with respect to a boundary between the process cartridges, as viewed in FIG. 2, the cartridge detection rib is provided at a left hand side of the boundary, and the reference detection rib is provided, adjacent to the cartridge detection rib, at a right hand side of the boundary. The reference detection rib is adjacent to the cartridge detection rib at the rear edge on the outer surface of the process cartridge. In other words, the reference detection rib is provided at a front portion on an outer surface of another process cartridge following the above-mentioned cartridge. Each reference detection rib is used to detect a carriage reference point to determine a development position for the other process cartridge following the above-mentioned another cartridge. Specifically reference detection rib 146 Bk, which provided on the outer surface of process cartridge 115C, is used to detect a carriage reference point of process cartridge 115Bk that is provided backward in the rotation direction from process cartridge 115C. When carriage reference sensor 118 detects reference detection rib 146Bk, photoconductive material 116Bk of process cartridge 115Bk, which is at an opposed side to reference detection rib 146Bk, is located at a position to form an electrostatic latent image on transfer film 106. In addition, since the side board of the carriage rotates accompanying the process cartridges attached in the carriage, cartridge detection ribs 145C, 145M, 145Y and 145Bk and reference detection ribs 146M, 146Y, 146Bk and 146C rotate together, while keeping the relationship between those positions.

Carriage reference sensor 118 is provided at a position such that the sensor 118 can detect the presence or absence of a process cartridge during the time the carriage is rotated by an angle required for cartridge opening 123 to obtain a cartridge storage place of the carriage one by one. Carriage reference sensor 118 detects cartridge detection ribs 145C, 145M, 145Y and 145Bk, and reference detection ribs 146M, 146Y, 146Bk and 146C.

The following description explains the relationship between carriage reference sensor 118, cartridge opening 123 and a cartridge storage place of the carriage. Namely, the carriage stops with the reference detection rib (146M, 146Y, 146Bk or 146C) opposite carriage reference sensor 118, and at this point, the cartridge storage place in the carriage located at an opposed position to carriage reference sensor 118 points to cartridge opening. As an example illustrated in FIG. 2, reference detection rib 146Bk for black attached to the storage place for a cyan process cartridge in the carriage is opposite carriage reference sensor 118, and the storage place for the cyan process cartridge points to cartridge opening 123.

Figure 3:
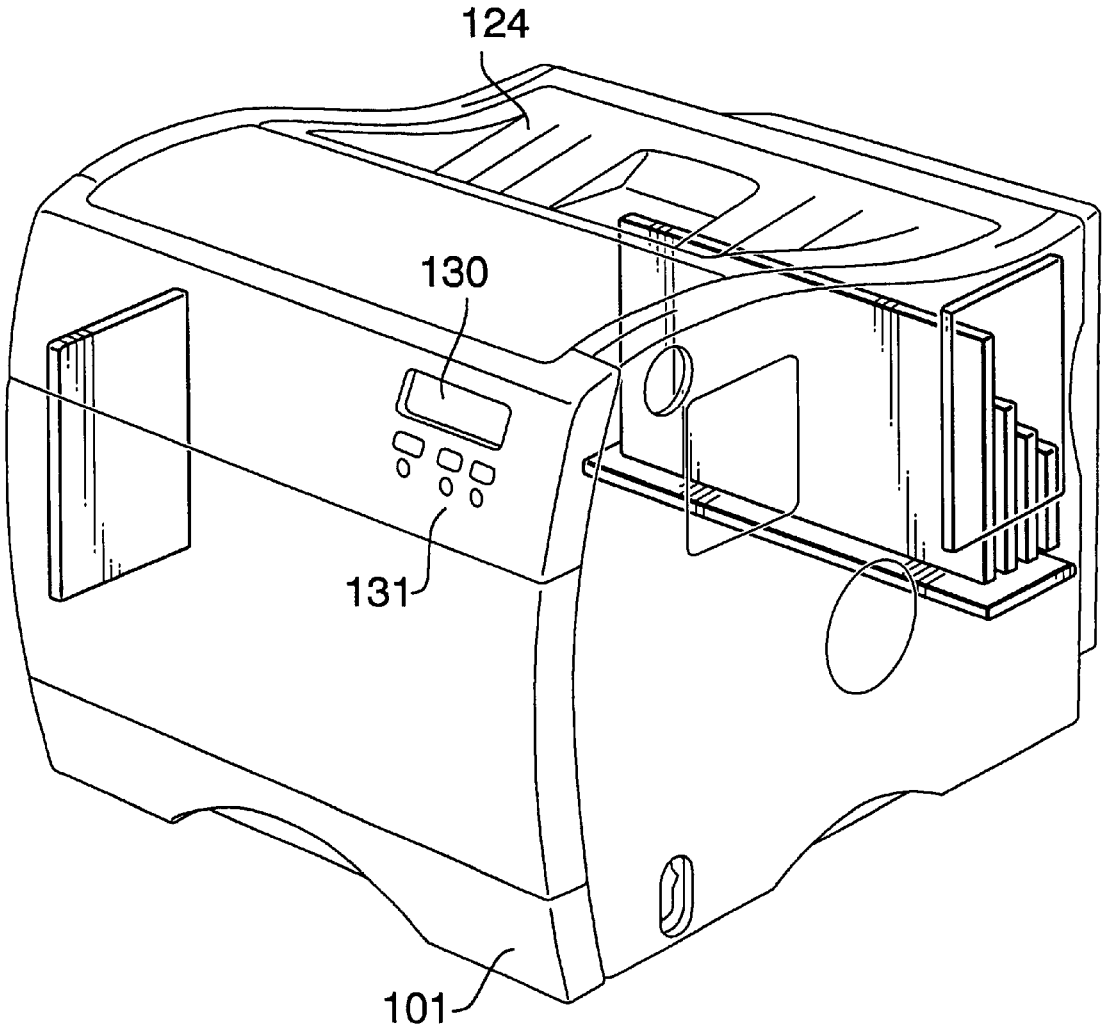
FIG. 3 is an appearance view of the recording apparatus according to the above embodiment.

FIG. 3 is an appearance view of the recording apparatus according to this embodiment. As illustrated in FIG. 3, door 124 is provided on a top surface of the main body of the apparatus to insert or remove the process cartridge into/from the carriage. Display 130 and operation section 131 are provided on a side surface of the main body of the apparatus. Display 130 displays a message to an operation, operation state of the apparatus, and others.

Figure 4:
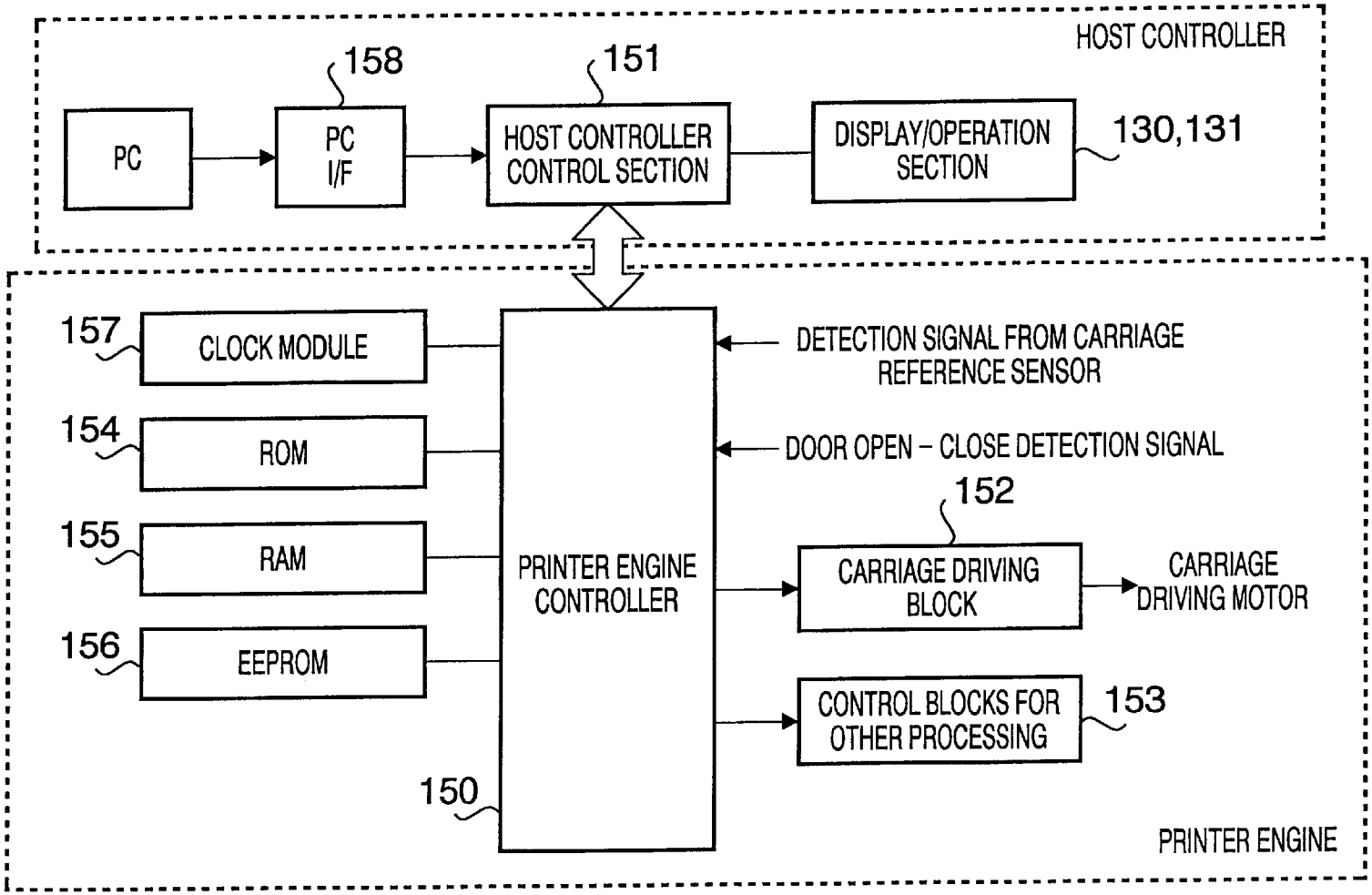
FIG. 4 is an electric functional block diagram of the recording apparatus according to the above embodiment.
Figure 5:
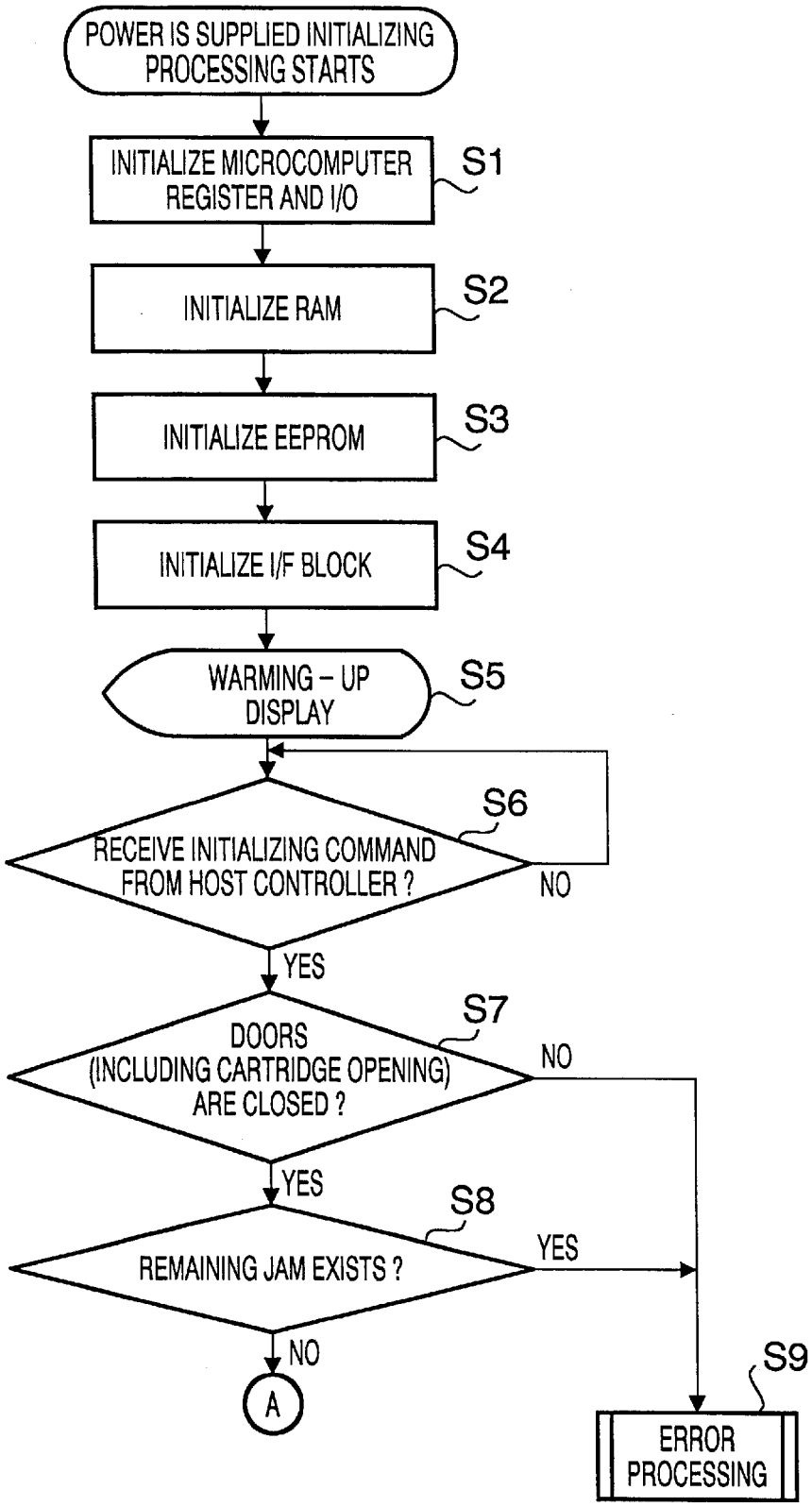
FIG. 5 is a flow diagram of a former part of initializing processing in the recording apparatus according to the above embodiment.
Figure 6:
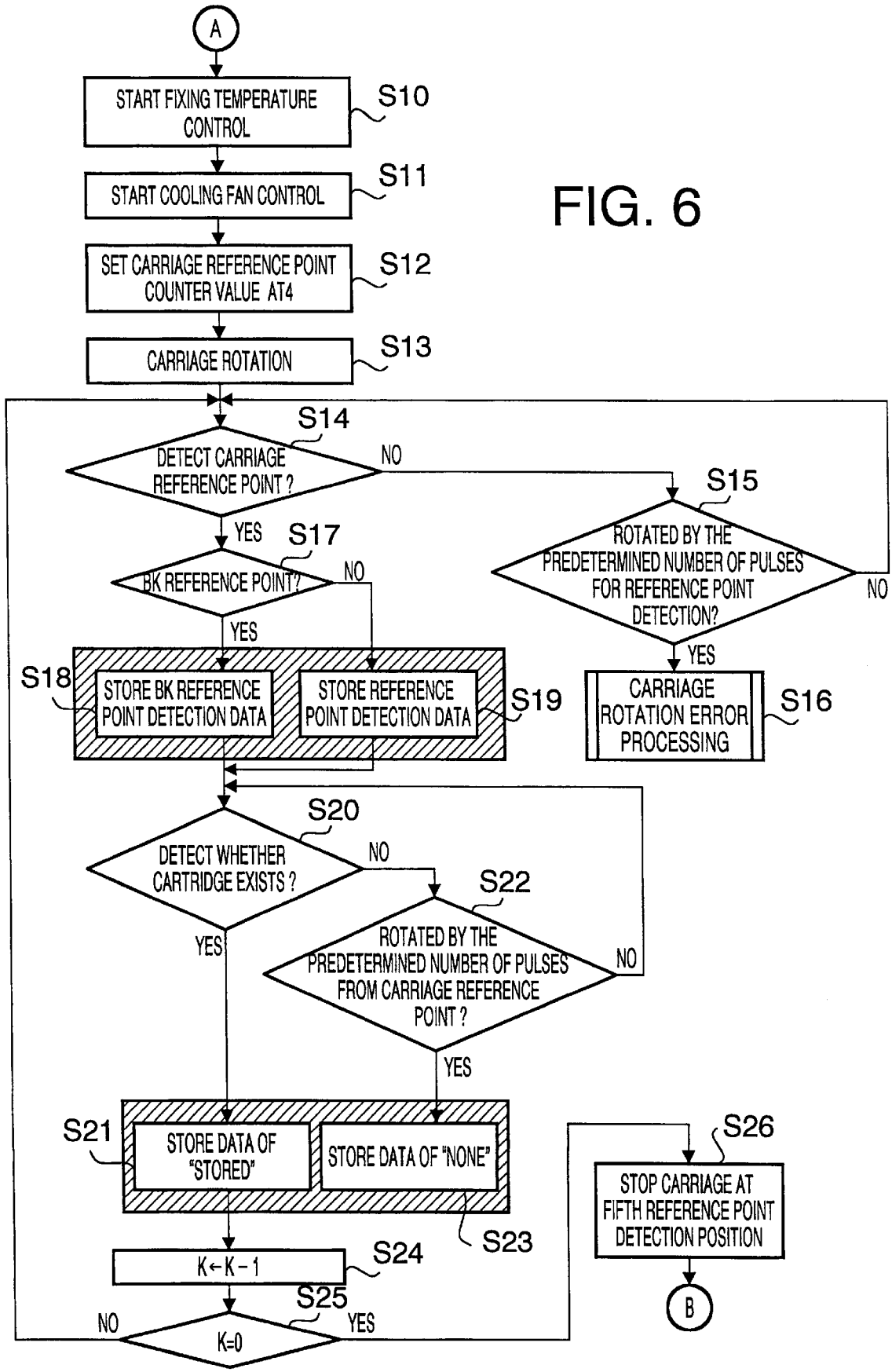
FIG. 6 is a flow diagram of an intermediate part of the initializing processing in the recording apparatus according to the above embodiment.
Figure 7:
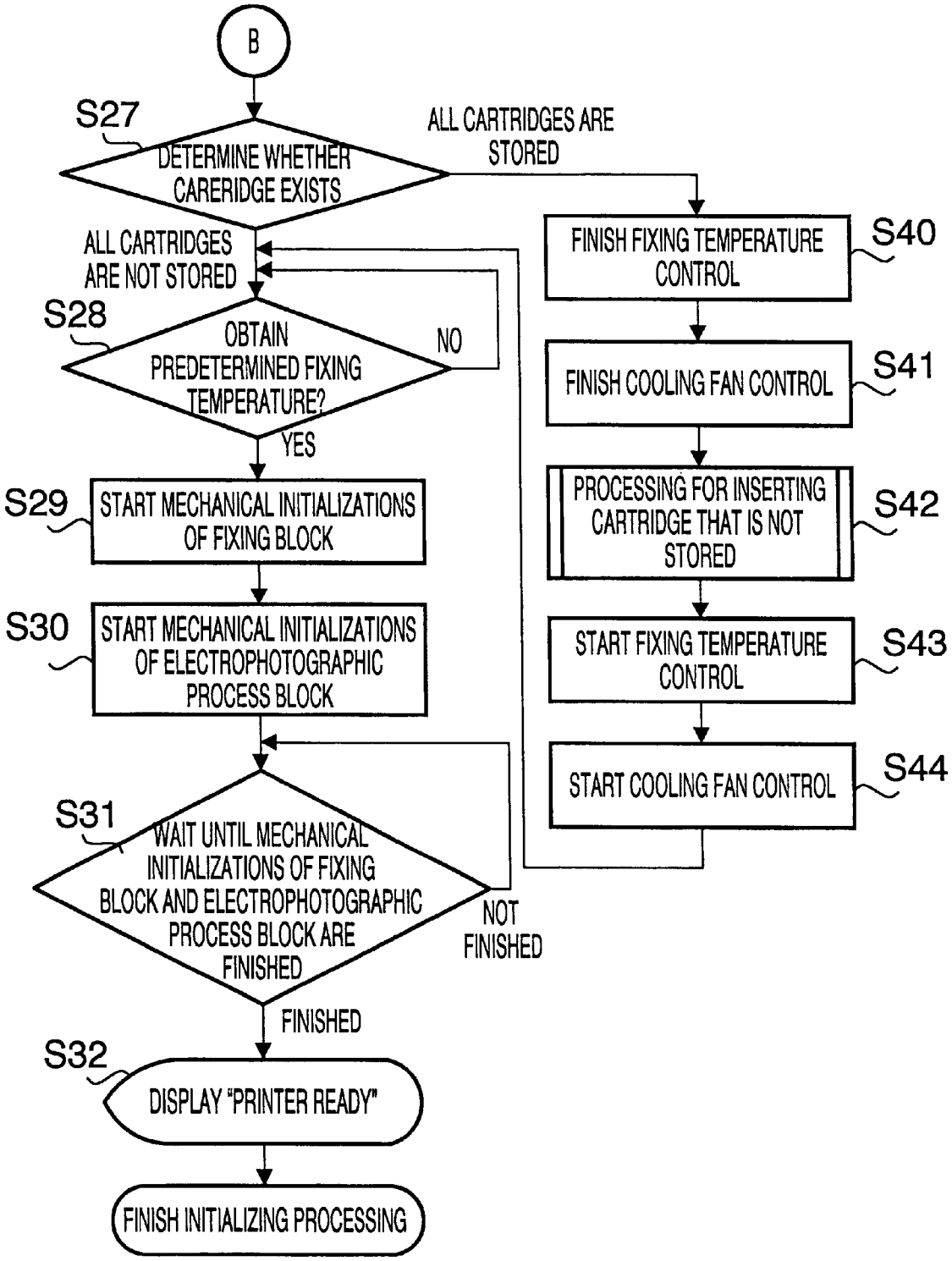
FIG. 7 is a flow diagram of a latter part of the initializing processing in the recording apparatus according to the above embodiment.

FIG. 4 is an electric functional block diagram of the recording apparatus according to this embodiment. The recording apparatus is comprised of a printer engine and a host controller. The operation of the printer engine is controlled by printer engine controller 150. Printer engine controller 150 controls various control blocks such as carriage driving block 152 in order to form an image based on video signals provided from host controller control section 151. The operation of the host controller is controlled by host controller control section 151. Host controller control section 151 generates image data to be printed, based on commands and image data respectively instructed and transferred from an external personal computer (PC) through PC interface 158, to output to the printer engine as video signals. Further host controller control section 151 displays an instruction message indicative of an instruction to attach a cartridge that is not stored and error message instructed from printer engine controller 150, and receives an instruction input by operator with operation section 131.

Carriage driving block 152 is to control the carriage driving motor. As described later, carriage driving block 152 receives an instruction from printer engine controller 150, and controls the carriage driving motor so that a storage place with no cartridge stops at cartridge opening 123.

Control blocks 153 for other processing include paper/document feed control block that controls the feeding of recording paper, electrophotography control block that controls the electrophotography process, belt transfer control block that controls the operation of transfer unit 105, fixing (rotation/temperature) control block that controls the operation of fixing unit 119, LSU control block that controls LSU 117, cooling fan control block that controls a cooling fan, I/F control block that controls host controller control section 151 and interface, optional unit control block that controls an optional unit such as an automatic both-sides unit. The LSU control block among those blocks receives video signals input from host controller control section 151, and performs analog modulation on the signals to output as a laser output.

Printer engine controller 150 is connected to devices such as clock module 157, ROM 154, RAM 155 and EEPROM 156. Clock module 157 supplies an operation clock of a microcomputer composing printer engine controller 150. ROM 154 stores various programs such as a program to control the carriage as described later. RAM 155 provides a work area for various processing executed by the program, while storing a detection result table illustrated in FIG. 12 as described later. EEPROM 156 is used to store counter data of a counter that counts the number of recording sheets and other data such as life of a process cartridge.

The following description specifically explains the operations of the recording apparatus in this embodiment with the above-mentioned configuration. FIGS. 5 to 9 are flowcharts of operations for exchanging a cartridge in the recording apparatus according to this embodiment.

Initializing processing starts when power is supplied. First, a dedicated register and I/O are initialized (step S1), and RAM 155 is initialized (step S2). Further data stored in EEPROM 156 is stored at a predetermined address in RAM 155 (step S3), and the I/F block is initialized (step S4).

At the time the above-mentioned initializing processing is finished, display 130 displays a warming-up display (step S5), and starts mechanical operation after receiving an initializing command from host controller control section 151 (step S6).

It is checked whether various doors including door 124 of cartridge opening 123 are closed based on detection signals from open-close sensors provided in respective doors (step S7). It is further checked whether no remaining paper jam exists in a paper path in the main body of the apparatus based on a detection signal from a sensor provided in the paper path (step S8). In addition, when an opened door or remaining paper jam is detected, the processing flow is branched to step S9 to execute error processing.

After no remaining paper jam is confirmed at step S8, the fixing temperature control is started (step S10), and the cooling fan control is started (step S11). Then the operation for detecting whether or not a cartridge is stored (hereinafter referred to as cartridge detection operation) starts.

Herein the principle of the cartridge detection operation is explained.

Figure 10A:
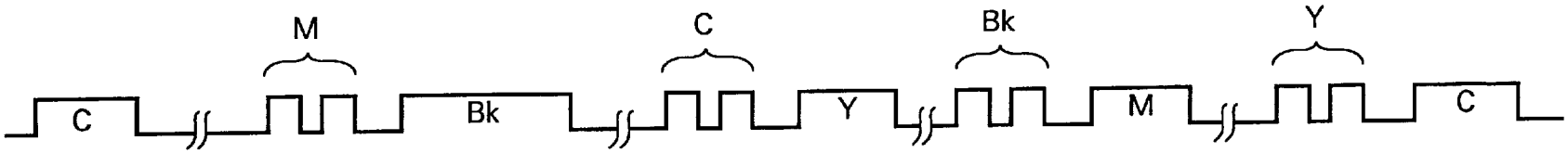
FIG. 10A is a diagram illustrating a first detect signal from a carriage reference sensor in the above embodiment.

FIG. 10A illustrates detection signal output from carriage reference sensor 118 during one complete rotation of the carriage with all the process cartridges attached therein. The cartridge detection signal is "ON" when cartridge detection ribs 145C, 145M, 145Y and 145Bk each passes in front of carriage reference sensor 118. The carriage reference detection signal is "ON" when reference detection ribs 146C, 146M, 146Y and 146Bk each passes in front of carriage reference sensor 118.

A size in the rotation direction of each of the reference detection ribs is longer than that of each of the cartridge detection ribs. Therefore based on the detection signals each indicative of the size of the rib, it is possible to determine whether the detected rib is the reference detection rib or cartridge detection rib.

The reference detection rib provided in the side board of the carriage is always detected even when the corresponding process cartridge is not stored. However the cartridge detection rib provided in the process cartridge is not detected when the process cartridge is not stored in the carriage. Accordingly when the cartridge detection rib is not detected during a period from some reference detection rib is detected to a next reference detection rib is detected, it is recognized that the corresponding process cartridge is not stored.

Figures 11, 12A, 12B, 12C, 12D:
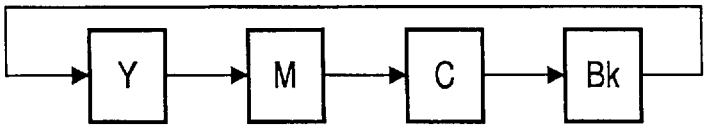
FIG. 11 is a diagram illustrating a cartridge rotating order.
FIG. 12A is a conception diagram of a detection result table in the above embodiment.
FIG. 12B is a diagram illustrating data in a determination result table obtained before being updated in the above embodiment.
FIG. 12C is a diagram illustrating data in the determination result table obtained after being updated once in the above embodiment.
FIG. 12D is a diagram illustrating data in the determination result table obtained after being updated twice in the above embodiment.

The size of reference detection rib 146Bk to detect a carriage reference point of process cartridge 115Bk for black(Bk) toner is made longer than that of each of the other reference detection ribs. As illustrated in FIG. 11, the rotation order of the process cartridge for each color toner is predetermined. Therefore, the identification of reference detection rib 146Bk for the black toner enables each of colors represented by the other reference detection ribs to be identified, and further enables each of colors represented by the cartridge detection ribs that are detected or not detected to be identified.

The one complete rotation of the carriage thus enables the storage place with no process cartridge to be detected, and further enables a current position of the storage place and the color for the cartridge to be stored in the storage place both to be recognized.

As described above, since four carriage reference points are detected by one complete rotation of the carriage, the number of remaining reference points in a carriage reference point counter is set at 4 before the cartridge detection operation (step S12). Then the carriage starts being rotated (step S13).

After the carriage starts being rotated, the detection of the carriage reference point is performed using the detection signal from carriage reference sensor 118 (step S14). When a signal appears that has a longer "ON" period corresponding to the reference detection rib, it is judged that the carriage reference point is detected.

In addition, the reference detection rib should be detected every quarter rotation regardless of the presence or absence of the cartridge. Therefore in the case where the carriage reference point is not detected even when the number of pulses exceeds the predetermined number of pulses required for the quarter rotation, it is considered that an error occurs. In this case, the processing flow is branched to step S16 to execute carriage rotation error processing.

Meanwhile, when a carriage reference point is detected, it is judged whether or not the obtained point is the carriage reference point for black (Bk) (stepS17). Since reference detection rib 146Bk is longer than each of the other reference detection ribs, it is possible to judge whether or not the obtained point is the carriage reference point for black (Bk) by analyzing a length of the "ON" period.

The carriage reference point detection results are registered in corresponding areas of the detection result table illustrated in FIG. 12A. When the carriage reference point for Black (Bk) is detected, "1" indicative of detection is written in an area for the Bk reference point (step S18). When the obtained point is not black (Bk) reference point, "0" is written in the area for the Bk reference point (step S19).

The cartridge detection is performed using the detection signal from carriage reference sensor 118 (step S20). As illustrated in FIG.10, when a signal appears that has two repeated short "ON" periods corresponding to the cartridge detection ribs, it is possible to judge that the corresponding cartridge exists. When it is judged that the cartridge exists, "1" is written in a corresponding column of a cartridge area of the detection result table illustrated in FIG.12A (step S21).

Figure 10B:
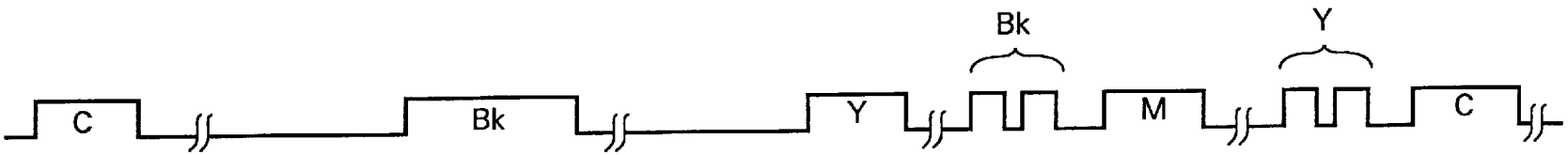
FIG. 10B is a diagram illustrating a second detect signal from the carriage reference sensor in the above embodiment.

In the case where a process cartridge is not stored in the carriage, as illustrated in FIG. 10B, the cartridge is not detected when the rotation corresponding to the predetermined number of pulses is completed after the detection of carriage reference point (C or Bk). Accordingly, in the case where the cartridge is not detected when the rotation corresponding to the predetermined number of pulses is completed after the detection of carriage reference point (step S22), "0" is written in a corresponding column of the cartridge area of the detection result table illustrated in 12A (step S23).

After the carriage reference point is detected, and the data on whether the cartridge exists is stored, the value of the carriage reference point detection counter is decreased by 1 (step S24). Then the processing of step S14 to step S24 is repeated until the value of the carriage reference point detection counter becomes 0. The detection result table in FIG.12A indicates the stored results obtained by Bk reference point detection and cartridge detection based on the detection signal in FIG. 10B.

At step S25, the value of carriage reference point detection counter is set at 0 when the carriage is rotated by one complete rotation, the carriage reference point is detected four times, and the cartridge detection data for four colors is stored. Then when the fifth carriage reference point detection is performed, the rotation of the carriage is stopped (step S26). In the case illustrated in FIG. 10B, when the reference detection rib 146C for cyan is detected at the fifth time of the carriage reference point detection, it is judged that the carriage is rotated by one complete rotation, and the rotation is stopped.

Next referring to the stored contents of the detection result table, it is determined whether the process cartridge for each color exists as illustrated in the determination result table (step S27). It is recognized whether or not the cartridge is stored by checking the corresponding cartridge area in the detection result table. When any cartridge is not stored, the processing flow is branched to step S40 to start preparing to attach a process cartridge that is not stored. First the fixing temperature control is finished (step S40), and the cooling fan processing is finished (step S41). Then the processing for inserting the process cartridge into a storage place in which the carriage does not store the cartridge is performed (step S42).

Figure 8:
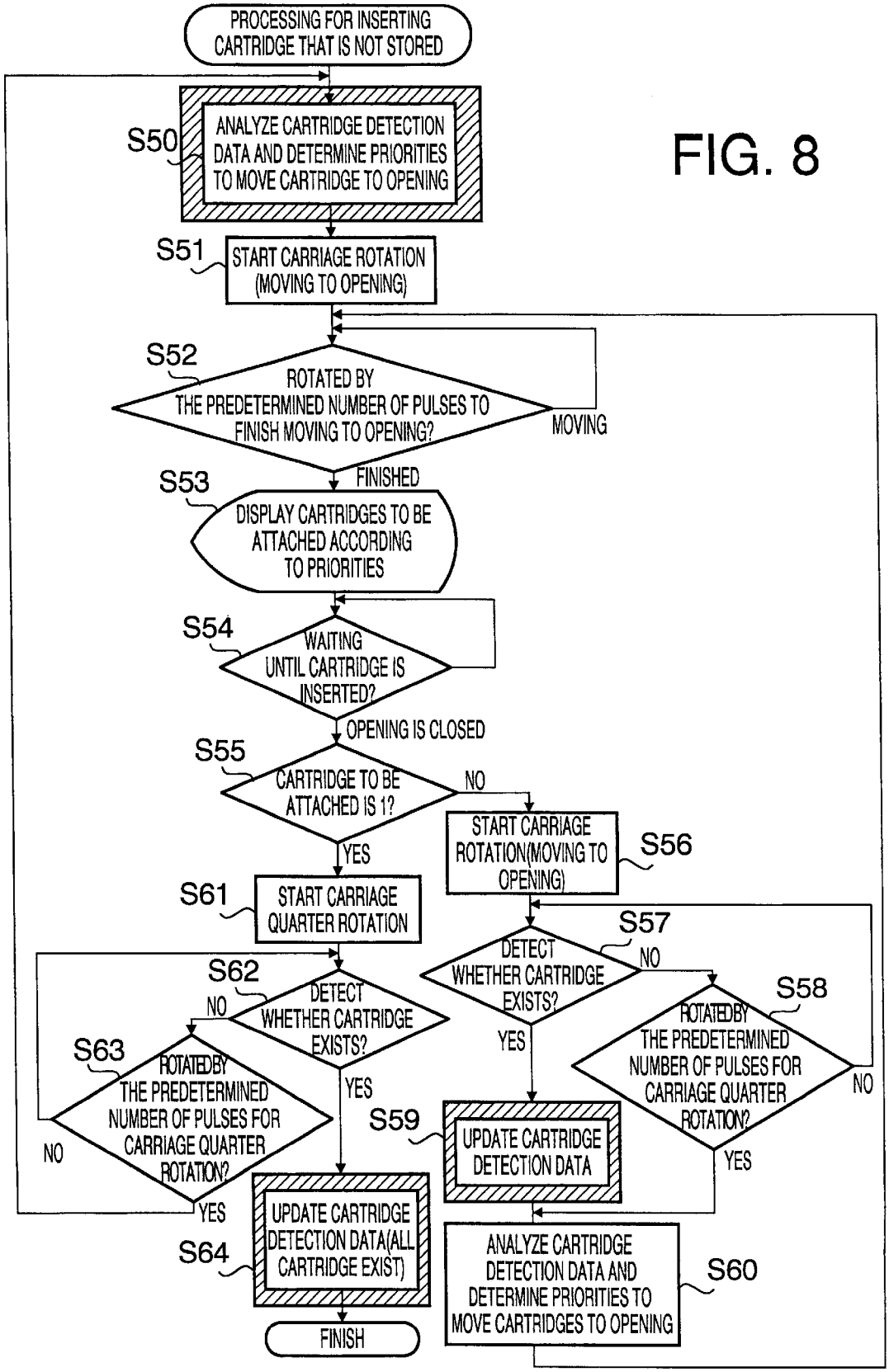
FIG. 8 is a flow diagram of processing for inserting a cartridge that is not stored in the recording apparatus according to the above embodiment.

FIG. 8 is a flowchart concerning the processing for inserting a cartridge into a storage place without the cartridge. In this embodiment, when the storage place in which a carriage does not store the process cartridge comes to an opposed position to cartridge opening 123, the rotation of the carriage is stopped.

To cope with it, the relation between the cartridge data and toner color is registered in the determination result table using as a reference the carriage reference point for black (Bk) registered in the detection result table. FIG. 12B is the determination result table. The contents of the determination result table is analyzed to recognize a position where the carriage rotation is currently stopped, the cartridge that is not stored, and a toner color of the cartridge, and then priorities of the storage places without the cartridges are determined to move the storage places without the cartridges the most efficiently to cartridge opening 123 (step S50). In the case illustrated in FIG. 12B, it is recognized that reference detection rib 146C for determining the reference point for cyan stops at a position of carriage reference sensor 118, and the process cartridges for magenta and cyan are not store. The storage place for a magenta process cartridge already exists at the opposed position to cartridge opening 123, in other words, exists the closest to cartridge opening 123, and is given the first priority. Then the storage place for a cyan process cartridge, which exists closest to the storage place with the first priority, is given the second priority. According to the priority, it is determined to move the storage places in which the carriage does not store the cartridges to cartridge opening 123 in the order of magenta and cyan. Further the numbers of pulses are determined, one of which is to move the first storage place without the cartridge from a current position to cartridge opening 123, and another of which is to move the second storage place without the cartridge from a current position to cartridge opening 123. In this example, since it is recognized that the storage place without the cartridge for magenta already points to cartridge opening 123, the number of pulses is determined to be 0.

Thus, since the storage places without the cartridge are moved to cartridge opening 123 in the fixed order based on the toner colors, it is possible to easily judge the order to attach the process cartridges. Further, in the case where a plurality of process cartridges are not stored in the carriage, the storage place without the cartridge that exists the closest to cartridge opening 123 is first moved to cartridge opening 123. Thereby, it is possible to minimize the time required to guide the first storage place without the cartridge to cartridge opening 123.

The control of carriage rotation is next started to move the storage place for the color with the first priority to the position opposite cartridge opening 123 (step S51), the rotation is performed during the period corresponding to the number of pulses obtained in step S50, and then stopped (step S52). Display 130 displays the instruction message indicative of the cartridges that are not stored and to be attached (step S53). In the case illustrated in FIG. 12B, since the number of pulses required for the cartridge for magenta with the first priority is 0, the carriage is neither rotated nor stopped actually, and the instruction message indicative of the cartridges to be attached is output.

The instruction message includes information indicative of the color for the process cartridge to be inserted. When an operator, who watches the message, opens door 124, the storage place for the cartridge for magenta exists at the opposed position to cartridge opening 123. Therefore, the operator does not perform any operation, and immediately can insert process cartridge 115M for magenta in the storage place for the magenta cartridge of the carriage.

Thus, it is possible for the operator to perform no operation on the carriage at all, and immediately insert process cartridge 115M for magenta in the storage place for the magenta cartridge of the carriage, thereby improving the operability of inserting a process cartridge.

Moreover, when the operator opens door 124 of cartridge opening 123, the storage place without the cartridge already points to cartridge opening 123. Thereby, the operator does not have to wait for the carriage to come to the predetermined position, and can insert the process cartridge immediately.

Further, the color of toner for the process cartridge that is not stored is notified, the operator can prepare in advance the process cartridge for the color to be attached, and open cartridge opening 123. Thereby, it is possible for the operator to save the time required for checking which color process cartridge is not stored when opens cartridge opening 123, and then bringing the cartridge.

Furthermore, the color of toner for the process cartridge that is not stored is notified, the operator does not need to look into the carriage to check which color process cartridge should be inserted into a storage place with no cartridge that currently points to cartridge opening 123 before inserting the cartridge.

Next the processing waits until process cartridge 115M is inserted (step S54). When it is detected that door 124 of cartridge opening 123 is closed from the door detection signal, it is judged whether or not the number of the storage places without the cartridges registered in the current determination result table is 1 (step S55).

Since such a number is 2 herein, the processing shifts to step S56 to start the carriage rotating to move the second storage place without the cartridge to the opposed position to cartridge opening 123. In this example, the rotation is continued until the storage place for the cyan cartridge moves to the opposed position to cartridge opening 123.

Thus, the carriage does not start rotating when door 124 of cartridge opening 123 is not closed. Thereby it is assuredly possible to prevent the operator from putting a his/her hand into the carriage, and the hand from pulling during the operation for inserting a process cartridge because the carriage starts rotating with cartridge opening 123 opened.

In addition, in the case where a plurality of storage places without process cartridges exists in the carriage, when the first process cartridge that is not stored is attached in the carriage, and cartridge opening 123 is closed, the apparatus controls the carriage so that the storage place without the second process cartridge moves to the position opposite cartridge opening 123 during the period when cartridge opening 123 is closed. Thereby, when door 124 is opened again, the storage place without the second process cartridge points to cartridge opening 123, resulting in the improved operability of inserting a process cartridge.

Herein, since process cartridge 115M for magenta is attached immediately before, reference detection rib 146C exists at the position of carriage reference sensor 118. When the carriage is rotated from the above-mentioned state, cartridge detection rib 145M of process cartridge 115M for magenta should be detected during the quarter rotation. When the rib 145M is not detected during the quarter rotation, it is suggested that door 124 is closed with process cartridge 115M not stored due to any reason.

Therefore, after door 124 is closed, and the rotation for the second storage place without the cartridge is automatically started, it is judged whether or not the process cartridge that is considered to be inserted before the carriage starts being rotated is detected (step S57).

When it is detected that the cartridge exists, the data at the corresponding column in the determination result table is updated (step S59). FIG. 12C illustrates that the updated determination result table in which the cartridge data for magenta is updated to "stored". After the cartridge data is updated, the processing flow shifts to step S60 to determine, in the same way as at step S50, the priority and the number of pulses to efficiently move the remaining storage place without the cartridge to the position opposite cartridge opening 123 using the updated table. However, herein the carriage is rotating now to move the second storage place without the cartridge that is the last storage place without the cartridge, it is not necessary to calculate the priority and the number of pulses.

Thus, the table in which the presence or absence of the process cartridge for each color is registered is provided, and the registered contents is updated whenever cartridge opening 123 is closed. Thereby it is possible to judge where is the next storage place without the cartridge, or that process cartridges are stored in all the storage places without the cartridges. As a result, even in the case where the number of the cartridge sensor is 1, and one complete rotation of the carriage is required to detect whether all the process cartridges exist, it is possible to conveniently judge which storage place without a cartridge is next moved to the position opposite the opening, and that attachment of all the process cartridges is completed.

On the other hand, when cartridge detection rib 145M of process cartridge 115M for magenta is not detected during the quarter rotation of the carriage (step S58), the processing flow shifts to step S60 without updating the table, and the number of pulses are determined that is required to move the first (magenta) storage place without the cartridge efficiently to the position opposite cartridge opening 123 on the assumption that the second (cyan) storage place without the cartridge is at such a position. In this example, since the number of the remaining storage places without the cartridge is 1, it is not necessary to determine the priority.

Thereby, even in the case where door 124 is closed without the process cartridge to be attached due to any reason, the result is made to be detected at the time of the quarter rotation, and the detected storage place without the cartridge is immediately set to be the object to be judged. As a result, it is possible to, after the cartridge is attached in the storage place without the cartridge that is currently moving (the door is closed), rotate the carriage automatically to move the next storage place without the cartridge to cartridge opening 123, while again displaying the instruction message indicative of the cartridge to be attached. Thus the rapid action is made possible.

Further, it is possible to detect whether the process cartridge is actually stored in the storage place therefor in parallel with the operation for moving the next storage place without the cartridge to the carriage opening. Thereby, it is possible to rapidly and efficiently perform the operations required until the storage of all the process cartridges is completed, as compared to the case where, after all the cartridges are considered to be stored in the carriage, the carriage is rotated by one completed rotation to judge whether all the process cartridges are actually stored to confirm.

Herein, since the second (cyan) storage place without the cartridge is moving to cartridge opening 123, the carriage stops at the time the cyan storage place without the cartridge arrives at the position opposite cartridge opening 123 (step S52), and the instruction message indicative of an instruction to attach the cartridge for cyan is displayed (step S53). The operator attaches the instructed color (cyan) process cartridge according to the message, and closes door 124.

The processing flow is branched to step S61 in the case where the process cartridge for magenta is inserted at the first cartridge attachment time, and the processing flow is branched to step S56 in the case where the process cartridge for magenta is not inserted at the first cartridge attachment time (step S55).

When the processing flow is branched to step S56, while moving the storage place without the cartridge for magenta to cartridge opening 123, it is detected whether the process cartridge for cyan is attached at the second cartridge attachment time. When the attached cartridge is detected, the determination result table is updated (step S59). Then the storage place without the cartridge for magenta is moved to cartridge opening 123 again, and the instruction message indicative of the cartridge to be attached is displayed. Thereby it is possible for the operator to recognize that the process cartridge for magenta is not attached at the last cartridge attachment time.

When the processing flow is branched to step S61, it is judged that the process cartridge for cyan, which is last set to be the object to be attached, is attached while rotating the carriage by the quarter rotation (steps S62 and S63). When the attached cartridge is detected, the determination result table is updated (step S64), and the cartridge attachment processing is finished. FIG. 12D illustrates the contents of the determination result table updated at step S64.

On the other hand, when the process cartridge is not detected by the quarter rotation, the process cartridge is considered to be not attached due to any reason, and the processing flow returns to step S50. Then the storage place without the cartridge is moved to cartridge opening 123 again, and the instruction message indicative of the cartridge to be attached is displayed. Thus, carriage reference sensor 118 is provided at a position such that it is possible to detect whether a process cartridge exists during the period when the carriage is rotated by the quarter rotation starting from the position of cartridge opening 123, and thereby it is possible to detect whether the process cartridge that is not stored is actually stored by the quarter rotation of the carriage after door 124 of carriage opening 124 is closed. As a result. it is possible to rapidly cope with the case where the operator closes door 124 of cartridge opening 123 incorrectly without storing the process cartridge, and also possible to start the recording operation immediately after the process cartridge that is not stored is actually stored, thus enabling the efficient processing.

After the attachment processing of the cartridges that are not stored is finished as described above, the fixing temperature control is started again at step S43, and the cooling fan control is started at step S44. Then when the fixing temperature is obtained (step S29), the mechanical initializations of the fixing block and electrophotographic process block are started (steps s29 and S30). When these mechanical initializations are finished (step S31), "printer ready" is displayed, and the initializing processing executed after the power is supplied is finished (step S32).

Figure 9:
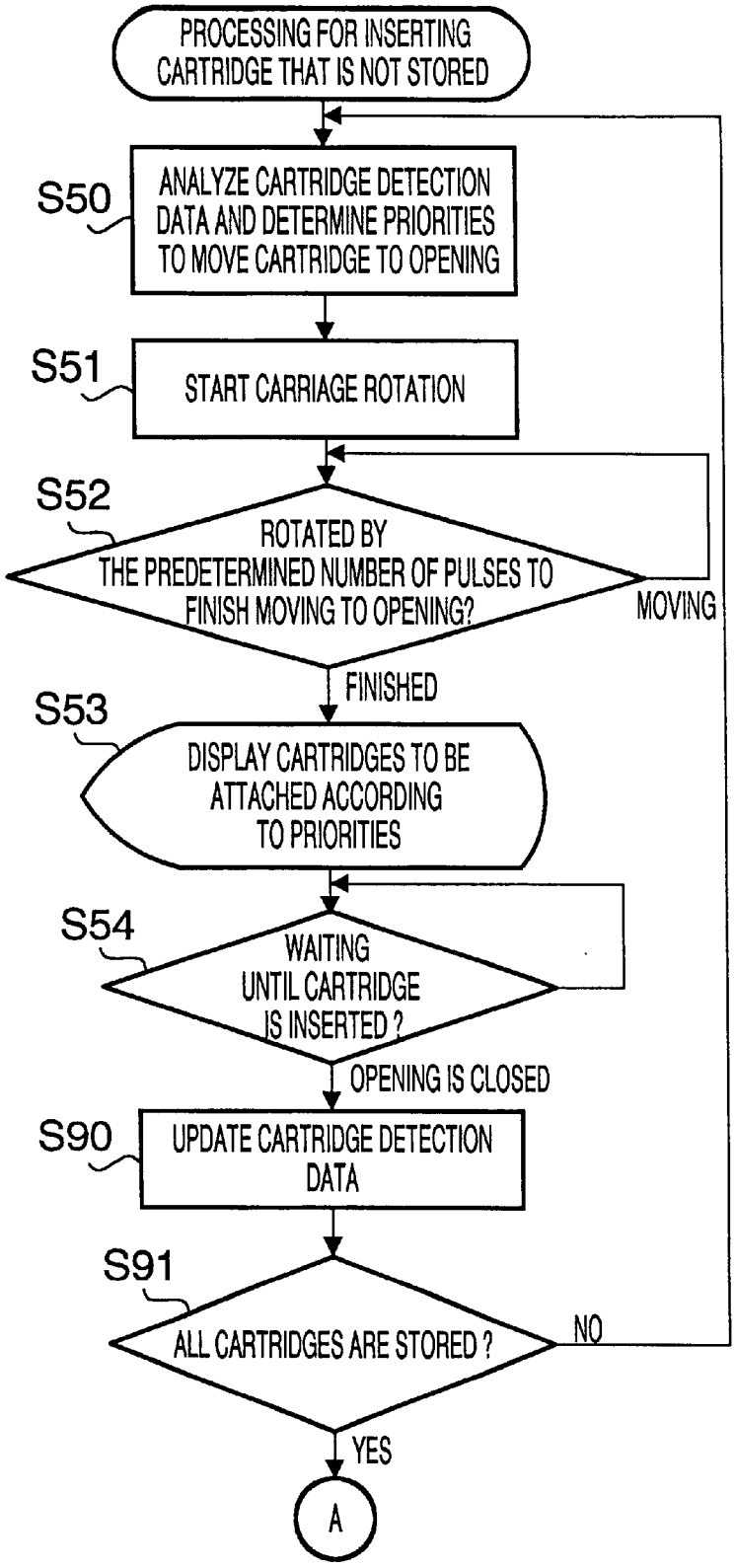
FIG. 9 is a flow diagram of a modified example of the processing for inserting the cartridge that is not stored in the recording apparatus according to the above embodiment.

FIG. 9 illustrates a modification example of the processing for inserting a cartridge that is not stored. The modification example executes the same processing as the above embodiment from step S50 to step S54, and the processing after step S55 is different from the processing in the above embodiment. The cartridge detection rib is not detected by carriage reference sensor 118 whenever door 124 is closed, and the determination result table is updated to make the cartridge data "stored" whenever door 124 is closed regardless of that the process cartridge that is not stored is actually inserted (step S90). The processing of step 50 to step 91 is repeated until indications indicative of cartridges that are not stored are canceled in the determination result table. In this example, the determination result table is not updated by checking whether the cartridge is actually inserted, and is updated based on whether door 124 is closed. Therefore it is not recognized whether the process cartridge is actually stored.

Hence when it is judged that the process cartridge that is not stored does not exist using the determination table in the processing of step S91, the processing flow shifts to step S10. Then the carriage is rotated once again, and when it is confirmed that all the process cartridges are stored (step S27), the processing flow shifts to step S28. On the other hand, when it is determined that any process cartridge is not stored yet by rotating the carriage again (step S27), the processing flow shifts to step S40 again to attach the process cartridge that is not stored in the carriage.

Thereby, also in the case where the determination result table is updated based on only whether or not door 124 is closed, it is possible to check whether or not all the process cartridges exist by rotating the carriage again after the registered contents indicates that all the process cartridges exist. As a result, the recording operation does not start with the opening closed without storing the process cartridge, and with the registered contents only updated. Therefore it is possible to assuredly prevent the recording operation from starting with the process cartridge not stored.

The present invention is not limited to the above described embodiments, and various variations and modifications may be possible without departing from the scope of the present invention.

This application is based on the Japanese Patent Application No.HEI11-249242 filed on Sep. 2, 1999, entire content of which is expressly incorporated by reference herein.

What is claimed is:

1. A recording apparatus, comprising:

a rotator that stores a plurality of process cartridges each with a different color toner, each of the cartridges having at least a development section;

a cartridge opening through which a process cartridge is attached and detached to and from said rotator;

a door providing said cartridge opening, said cartridge opening being opened and closed by said door;

a determiner that determines whether a color toner process cartridge is stored or not stored and whether said door is closed, and a controller that, when said determiner determines that the process cartridge is not stored and said door is closed, controls said rotator to move a cartridge storage location, at which the process cartridge is not stored on said rotator, to a position opposite said cartridge opening.

2. The apparatus according to claim 1, wherein the cartridge opening is provided opposite an outer surface of said rotator, and has a size enabling attachment and detachment of one of the process cartridges.

3. The apparatus according to claim 1, wherein based on a determined result of said determiner, after said controller rotates said rotator to move the cartridge storage location, at which the process cartridge is not stored on said rotator to the position opposite the cartridge opening, said controller notifies an operator that the color toner process cartridge is not stored.

4. The apparatus according to claim 1, wherein after said controller rotates said rotator to move a cartridge storage place in which said rotator does not store the process cartridge to the position opposite the cartridge opening, said controller notifies an operator that the cartridge storage place is opposite the cartridge opening.

5. The apparatus according to claim 1, wherein said controller determines priorities corresponding to the cartridge storage places, and when a plurality of process cartridges are not stored in said rotator, controls said rotator to move the cartridge storage place in which said rotator does not store the process cartridge to the position opposite said cartridge opening according to the priorities.

6. A recording apparatus, comprising:

a rotator that stores a plurality of process cartridges each with a different color toner, each of the cartridges having at least a development section;

a cartridge opening through which a process cartridge is attached and detached to and from said rotator;

a register that registers whether or not the process cartridges with each different color toner are stored in said rotator, and a controller that controls said rotator to move a cartridge storage location, at which the process cartridge is not stored on said rotator to a position opposite said cartridge opening after said cartridge opening is closed when a plurality of process cartridges are not stored, while updating contents registered in said register corresponding to an already stored process cartridge;

wherein, when a plurality of process cartridges are not stored, said controller controls said rotator to move a cartridge storage location, at which the process cartridge is not stored on said rotator, to the position opposite the cartridge opening while updating the contents registered in said register corresponding to the already stored process cartridge, and when the contents registered in said register is indicative that all the process cartridges are stored, said controller again checks whether any process cartridge is not stored in said rotator.

7. A recording apparatus comprising:

a rotator that stores a plurality of process cartridges each with a different color toner, each of said cartridges having at least development section;

a cartridge opening through which a process cartridge is attached and detached to/from said rotator;

a sensor that detects whether or not the process cartridge is stored in said rotator during a time said rotator is rotated by an angle corresponding to a single cartridge storage place from a position opposite said cartridge opening; and a controller that controls said rotator when the process cartridge is not stored, in such a manner as to rotate said rotator by the angle corresponding to the single rotator storage place from the position opposite said cartridge opening after said cartridge opening is closed, detects whether or not the process cartridge is stored using the sensor during the time said rotator is rotated, and when the process cartridge is not stored, again move the cartridge storage place in which said rotator does not store the process cartridge to the position opposite said cartridge opening.

8. A recording apparatus, comprising:

a rotator that stores a plurality of process cartridges each with a different color toner, each of the cartridges having at least a development section;

a cartridge opening through which a process cartridge is attached and detached to and from said rotator;

a sensor that detects whether or not the process cartridge is stored in said rotator;

a register that registers a detection result obtained by said sensor, and a controller that detects whether or not the process cartridge is stored during a time that a next cartridge storage location, at which another process cartridge is not stored on said rotator, is moved to said cartridge opening, and updates registered contents in said register when a plurality of process cartridge are not stored;

wherein said sensor detects whether or not the process cartridge is stored during a time that said rotator is rotated by an angle corresponding to a single cartridge storage location from the position opposite said cartridge opening.

* * * * *